US006972052B2

(12) United States Patent
Krumma et al.

(10) Patent No.: US 6,972,052 B2
(45) Date of Patent: Dec. 6, 2005

(54) ROTATIONAL ATOMIZER WITH EXTERNAL HEATING SYSTEM

(75) Inventors: Harry Krumma, Bonnigheim (DE); Frank Herre, Oberriexingen (DE); Michael Baumann, Flein (DE); Rainer Melcher, Oberstenfeldt (DE); Stefano Giuliano, Gerlingen (DE); Marcus Kleiner, Bietigheim-Bissingen (DE)

(73) Assignee: Behr Systems, Inc., Auburn Hills, MI (US)

( * ) Notice: Subject to any disclaimer, the term of this patent is extended or adjusted under 35 U.S.C. 154(b) by 38 days.

(21) Appl. No.: 10/650,308

(22) Filed: Aug. 28, 2003

(65) Prior Publication Data

US 2004/0081769 A1 Apr. 29, 2004

(30) Foreign Application Priority Data

Aug. 28, 2002 (DE) ..... 102 39 517

(51) Int. Cl.[7] ..... B05B 7/00; B05B 3/10

(52) U.S. Cl. ..... 118/300; 118/302; 239/223; 239/703

(58) Field of Search ..... 118/300, 302; 239/223, 224, 699–700, 703

(56) References Cited

U.S. PATENT DOCUMENTS

| | | | | |
|---|---|---|---|---|
| 3,536,580 A | | 10/1970 | LaFave | 162/186 |
| 3,979,535 A | * | 9/1976 | Govindan | 427/422 |
| 4,376,135 A | | 3/1983 | Patel et al. | 427/31 |
| 4,521,462 A | | 6/1985 | Smythe | 427/421 |
| 4,572,437 A | | 2/1986 | Huber et al. | 239/703 |
| 4,589,597 A | | 5/1986 | Robisch et al. | 239/703 |
| 4,684,064 A | | 8/1987 | Kwok | 239/223 |
| 4,700,896 A | | 10/1987 | Takeuchi et al. | 239/693 |
| 4,715,314 A | | 12/1987 | Ramseier et al. | 118/631 |
| 4,852,810 A | | 8/1989 | Behr et al. | 239/703 |
| 4,919,333 A | | 4/1990 | Weinstein | 239/223 |
| 4,927,081 A | | 5/1990 | Kwok et al. | 239/223 |
| 4,944,459 A | | 7/1990 | Watanabe et al. | 239/305 |
| 4,955,960 A | | 9/1990 | Behr et al. | 239/3 |
| 5,011,086 A | | 4/1991 | Sonnleitner et al. | 239/691 |
| 5,078,321 A | | 1/1992 | Davis et al. | 239/224 |
| 5,127,125 A | | 7/1992 | Skibowski | 15/104.061 |
| 5,133,499 A | | 7/1992 | Schneider | 239/104 |
| 5,294,217 A | | 3/1994 | Talacko et al. | 406/91 |
| 5,300,006 A | | 4/1994 | Tanaka et al. | 483/56 |
| 5,397,063 A | | 3/1995 | Weinstein | 239/703 |
| 5,622,563 A | | 4/1997 | Howe et al. | 118/620 |
| 5,633,306 A | | 5/1997 | Howe et al. | 524/409 |
| 5,662,278 A | | 9/1997 | Howe et al. | 239/700 |
| 5,683,032 A | | 11/1997 | Braslaw et al. | 239/7 |
| 5,704,977 A | | 1/1998 | Baumann et al. | 118/323 |
| 5,788,164 A | * | 8/1998 | Tomita et al. | 239/700 |
| 5,863,613 A | * | 1/1999 | Emch | 427/479 |
| 5,865,380 A | | 2/1999 | Kazama et al. | 239/704 |

(Continued)

FOREIGN PATENT DOCUMENTS

| | | | |
|---|---|---|---|
| DE | 34 29 075 A 1 | 2/1986 | B05B 5/04 |

(Continued)

*Primary Examiner*—Chris Fiorilla
*Assistant Examiner*—Yewebdar Tadesse
(74) *Attorney, Agent, or Firm*—Howard & Howard

(57) ABSTRACT

In a coating device with a rotary atomizer, for preventing the condensation of spray cabin air on components cooled by the lower-pressure exhaust air of the drive turbine of the atomizer, a heating device is provided, which can heat air flowing through the atomizer or components in heat-conductive contact with the outlet path of the turbine exhaust air.

13 Claims, 1 Drawing Sheet

U.S. PATENT DOCUMENTS

Figure 1:
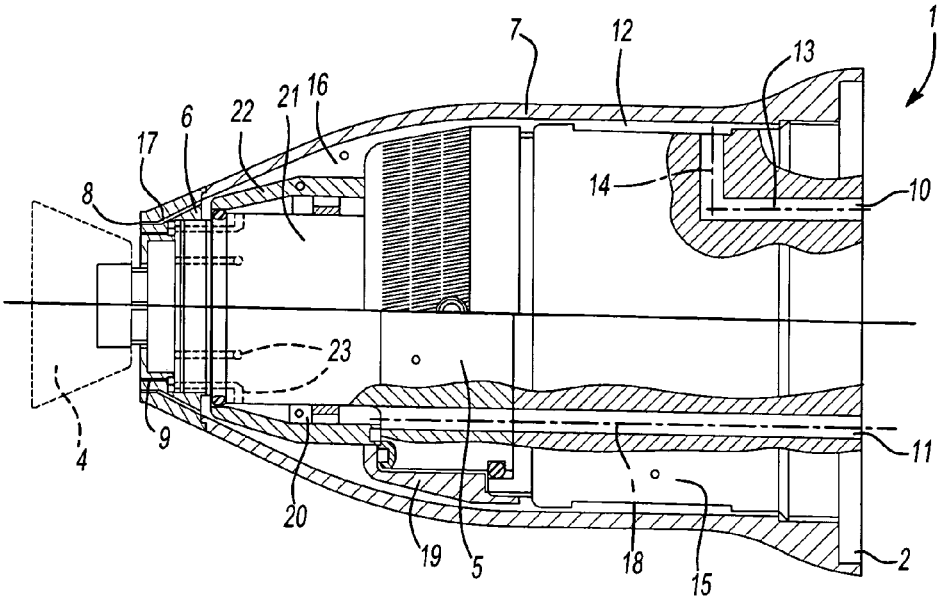

| | | | | |
|---|---|---|---|---|
| 6,037,010 | A | 3/2000 | Kahmann et al. | 427/421 |
| 6,090,450 | A | 7/2000 | Kahmann et al. | 427/421 |
| 6,508,610 | B2 | 1/2003 | Dietrich | 406/13 |
| 6,589,348 | B2 | 7/2003 | Ott | 118/684 |
| 6,637,215 | B1 * | 10/2003 | Leathers | 62/87 |
| 2004/0164190 | A1 * | 8/2004 | Baumann et al. | 239/700 |

FOREIGN PATENT DOCUMENTS

| | | | |
|---|---|---|---|
| DE | 41 05 116 A 1 | 8/1992 | B05B 5/04 |
| DE | 43 06 800 A 1 | 9/1994 | B05B 3/02 |
| DE | 43 42 128 A1 | 6/1995 | B05B 12/02 |
| DE | 196 10 588 A 1 | 9/1997 | B05B 13/02 |
| DE | 197 09 988 A 1 | 10/1998 | B05B 12/00 |
| DE | 197 42 588 A1 | 4/1999 | B05D 1/00 |
| DE | 198 30 029 A 1 | 1/2000 | B05B 12/14 |
| DE | 199 09 369 A 1 | 9/2000 | B05B 5/04 |
| DE | 199 37 425 A 1 | 3/2001 | B05B 7/24 |
| DE | 100 33 986 A 1 | 1/2002 | B05B 15/00 |
| DE | 100 63 234 C 1 | 7/2002 | F16L 11/22 |
| DE | 101 30 173 A 1 | 1/2003 | B05B 12/14 |
| EP | 0 283 917 A | 9/1988 | B05B 3/10 |
| EP | 0 767 005 A1 | 4/1997 | B05B 5/04 |
| EP | 0 801 991 A3 | 10/1997 | B05B 5/04 |
| EP | 0 904 848 A1 | 3/1999 | B05B 12/14 |
| EP | 0 967 016 A1 | 12/1999 | B05B 3/10 |
| EP | 1 108 475 A2 | 6/2001 | B05B 5/16 |
| EP | 1 114 677 A1 | 7/2001 | B05B 12/14 |
| EP | 0 796 663 B1 | 8/2001 | B05B 5/04 |
| EP | 1 172 152 A1 | 1/2002 | B05B 12/14 |
| WO | WO 94/22589 | 10/1994 | B05B 5/00 |

* cited by examiner

ROTATIONAL ATOMIZER WITH EXTERNAL HEATING SYSTEM

BACKGROUND OF THE INVENTION

1. Field of the Invention

The invention concerns a coating device with a rotary atomizer mounted on a coating machine for mass-production coating of workpieces and a method to control the operation of such a coating device according to the preamble of the independent claims.

2. Relevant Prior Art

Driving the bell-shaped plate of rotary atomizers that are typical for electrostatic mass-production coating of workpieces, such as vehicle chassis, by compressed air turbines at an extremely high rpm is known (DE 34 29 075, DE 43 06 800, EP 0 796 663, EP 0 801 991, etc.). At the inlet, the air flowing through the turbine is at approximately the same temperature as the surroundings, and the air is cooled due to the pressure drop in the turbine to temperatures that depend on the turbine output and that appear in conventional painting systems, e.g., on the order of −20° C. If the output of the turbine is to be further increased, among other things, due to the increasing desire in recent times for even higher rpm values and amounts of paint discharge, cooling of the air at the turbine outlet can result in temperature values below −40° C.

Even for turbines of relatively low output, problems can arise because of the formation of condensation water due to the cooling, when the water content (pressure dew point) of the compressed air fed to the turbine does not correspond to the values set for the coating system. Problems due to incorrect pressure dew point can be solved by heating the feed air to the turbine. However, condensation water is produced, particularly due to strong cooling effects of increased-output turbine motors, a higher rpm and greater amounts of paint discharge through condensation of the air on the components of the atomizer and the coating machine, which contact the exhaust gas in a heat-conductive way and which come into contact with the surrounding air in the spray cabin with an air humidity of typically more than 50%. Because the exhaust gas of the turbine could disturb the coating process, if it were to be discharged directly onto the atomizer in the cabin, the exhaust gas is typically deflected by the arm of the coating machine, such as a painting robot, carrying the atomizer, so that, e.g., also the surfaces of the flange connection between the atomizer and the hand joint of the machine and the adjacent areas of the machine arm are cooled with the result of the formation of condensation water. The resulting water drops can cause painting errors.

SUMMARY OF THE INVENTION AND ADVANTAGES

The problem of the invention is to present a coating device or a method, which, above all, can prevent as much as possible the condensation of surrounding air on components of the atomizer and/or the coating machine for electrostatic rotary atomizers with high drive output.

This problem is solved by the features of the claims.

A first measure for preventing the formation of condensation water is the heating of the drive gas of the turbine, which is usually compressed air. Cooling that is too great can be prevented in many coating systems by heating the drive air, but direct heating of the exhaust air of the turbine is advantageous, above all, because if only the supply air is heated, a portion of the heating energy is lost through heat conduction to the supply side of the atomizer, which is less affected by the formation of condensation water, and/or has the consequence of undesired heating of components of the atomizer located at this position. In general, the possibility of heating is limited by the permissible maximum temperatures of the affected components or line hoses, etc., sometimes made of plastic.

The heating of the exhaust gas of the turbine can be especially advantageous by means of a heat exchanger, which carries on one side an air flow from the exhaust air and on the other side an air flow from the supply air of the turbine or also from a separately supplied liquid or gaseous medium, such as heated air. When the heated supply air is guided through the heat exchanger, a single heating device is sufficient for heating the supply air and also the exhaust gas as an additional measure, without producing additional consumption of air for this heating at two different locations. Here, it is also advantageous that supply air channels and adjacent components can be prevented from becoming too strongly heated.

However, the exhaust air of the turbine can also be heated by mixing in warmer air. For example, compressed air from the existing compressed air network of the coating system or air directed by a fan into the exhaust air stream can be guided directly to the outlet opening of the bearing unit of the turbine. The amount and temperature of this added air can be set to relatively low values in order to prevent undesired condensation as a function of the exhaust air temperature and the air humidity.

The cooling of the components through a drop in pressure of the drive air of the turbine depends on the load and becomes greater the higher the rpm, the amount of paint sprayed per unit time, the diameter, or the mass of the bell-shaped plate, as well as the time utilization ratio of the atomizer during a painting cycle. In addition, for rising loads, higher amounts of air consumption are required, which, in turn, amplify the cooling. For these reasons, other measures in addition to or instead of heating of the drive air of the turbine can be advantageous for high-load atomizers.

Among other things, a suitable possibility for this purpose is the heating of bearing air of the turbine, which has a shaft that rotates in an air bearing in a known way. The heating of the bearing air has the advantage that the bearing air flows through a large part of the turbine and therefore the turbine can be heated more uniformly.

However, the amount of air and thus the heat capacity of the bearing air is relatively small. Therefore, it can be advantageous to guide more strongly heated amounts of air (e.g., on the order of 100 L/min) through additional channels, i.e., which do not exist in known atomizers and coating machines, in the bearing unit and/or other components of the atomizer or the coating machine separately from the path of the drive air.

Another possibility is to heat the steering air, which flows past the bearing unit of the turbine in a known way, if necessary over different paths, and/or through the turbine (DE 102 33 198). The steering air temperature is set so that the spray cone formed by the steering air is not negatively affected and no undesired effects are produced on the painting process.

Components of the atomizer and/or the coating machine at risk of condensation from the cabin air can also be heated directly with gaseous or liquid heating media supplied from the outside. For example, outside of the atomizer itself, the flange construction on the robot wrist, the wrist joint, and/or the robot arm can also contain corresponding channels for the heated media.

The temperature of the air or other media supplied for reducing the cooling can be controlled preferably as a function of one or more temperature sensors, which measure, e.g., the temperature of the supply air and/or the exhaust air of the turbine, the motor bearing air, if necessary, the steering air, and/or components of the atomizer or the coating machine adjacent to the supply and exhaust air paths of the turbine air and which can control the pre-heating temperature with an associated controller preferably in a closed control loop. Instead of the control by means of temperature sensors or independent of these sensors, the pre-heating temperature can also be controlled based on preset diagrams or stored program data as a function of rpm and amount of paint, and thus as a function of load.

The arrangement of an electrical heating device outside of the atomizer for preferably electrically insulated heating media supplied to the atomizer for the purpose described here has, above all, the advantage that problems relative to the required voltage isolation between the heating device and the components of the atomizer at high voltage are avoided in electrostatic atomizers with direct charging of the coating material.

However, for suitable voltage isolation and for atomizers with external charging, the condensation of the cabin air on cold components of the atomizer or the coating machine can also be prevented through installation of a heating device directly in the affected components. In addition, an electrically conductive heating fluid, e.g., water, or an electric heating coil can be used in this case.

All of the possibilities described above for preventing too strong a cooling can be used alone or also in any combination and lead to the reliable prevention of disruptive formation of condensation water according to the installation and operation of the coating system. One particular advantage of the invention is that strong temperature differences within the atomizer can be prevented, which could lead to interruptions in operation or damage to components due to different expansion coefficients. The measures described here do not provide point-wise, but instead uniform heating of the components.

BRIEF DESCRIPTION OF THE DARWINGS

Other advantages of the present invention will be readily appreciated as the same becomes better understood by reference to the following Detailed Description when considered in connection with the accompanying drawings.

The invention is described in more detail for the embodiment shown in the drawing. Shown are:

FIG. 1 a cross-sectional view of an electrostatic rotary atomizer; and

Figure 2:
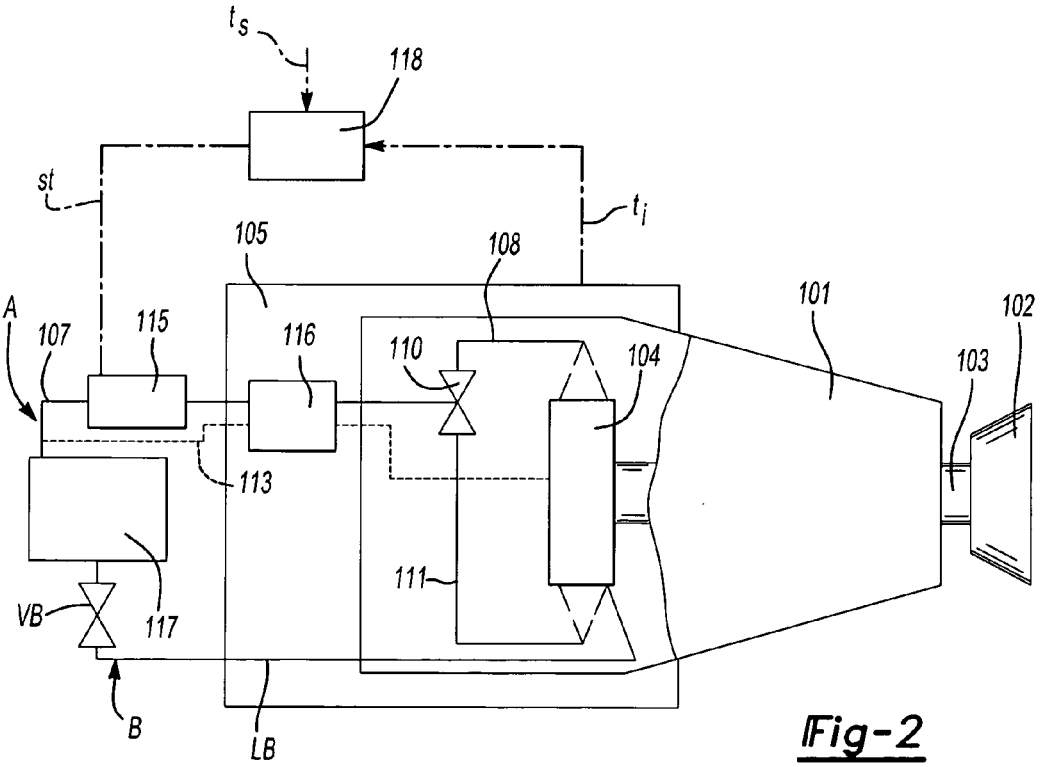

FIG. 2 an advantageous example for the air supply of the turbine motor of the rotary atomizer in schematic illustration.

DETAILED DESCRIPTION OF THE PREFERRED EMBODIMENT

Referring to the FIGS., wherein like numerals indicate like or corresponding parts throughout the several views, a rotary atomizer 1 reproduced in FIG. 1 has the construction described in DE 102 33 198 and can be mounted with its attachment flange 2, e.g., at the wrist of a painting robot. For driving its rotating bell-shaped plate 4, it contains a compressed-air tubine 5, whose drive air is supplied by the painting robot over the attachment flange 2, with the supply of the drive air not shown here for simplification.

For shaping the spray stream output from the bell-shaped plate 4, there is a steering air ring 6, which is arranged in the bell-shaped plate-side end surface of a housing 7 of the rotary atomizer 1. Several steering air nozzles 8, 9 directed in the axial direction are arranged in the steering air ring 6. During operation of the rotary atomizer 1, a steering air current can be blown by these steering air nozzles outwards in the axial direction onto the conical surface shell of the bell-shaped plate 4. The spray stream is shaped and the desired spray width is set as a function of the amount and the speed of the steering air blown from the steering air nozzles 8, 9.

Here, the supply of the steering air for the two steering air nozzles 8, 9 is realized by corresponding flange openings 10, 11, which are arranged in the attachment flange 2 of the rotary atomizer 1. The position of the flange opening 10, 11 within the end surface of the attachment flange 2 is set by the position of the corresponding connections to the associated attachment flange of the painting robot.

The outer steering air nozzle 8 is supplied in a conventional way by a steering air line 12, which is guided along the outside of the compressed air turbine 5 between the housing 7 and the compressed air turbine 5. Here, the flange opening 10 first opens into an axial hole 13, which then transitions into a radial hole 14, which finally opens at the outside of a valve housing 15 into an intermediate space between the housing 7 and the valve housing 15. The steering air is then led past the compressed air turbine 5 into an air space 16, where it is finally guided through needle holes 17 in the steering air ring 6 to the steering air nozzle 8.

In contrast, the supply of steering air for the steering air nozzle 9 is realized by a steering air line 18, which starts from the flange opening 11 in the attachment flange 2 in the axial direction and passes without kinks through the valve housing 15. In addition, the steering air line 18 also passes through a bearing unit 19 of the compressed air turbine 5 in the axial direction. The radial distance of the steering air line 18 from the axis of rotation of the bell-shaped plate 4 is greater than the outer diameter of the turbine wheel, which is not shown for simplification, so that the steering air line 18 runs on the outside of the turbine wheel. The steering wheel line 18 then opens on the side of the bell-shaped plate into another air space 20, which is arranged between an essentially cylindrical section 21 of the compressed air turbine 5 and a cover 22 surrounding this section.

Several holes 23, which open in the end surface of the compressed air turbine on the side of the bell-shaped plate and finally open into the steering air nozzles 9, are located in the surface shell of the section 21. The holes 23 in the section 21 of the compressed air turbine 5 here consist of a needle hole starting from the surface shell of the section 21 in the radial direction and a needle hole starting from the bell shaped plate-side end surface of the section 21 in the axial direction, which enables simple assembly.

The air supply of the compressed air turbine 5 of the atomizer according to FIG. 1 can correspond, e.g., to the schematic shown in FIG. 2. As described in the EP Application No. 02 006 826.8, here additional air at higher pressure is supplied for increased demands on drive energy of the primary power supply line to the air turbine over a switchable, separate channel.

The compressed air turbine has a bearing unit 101 for an air-supported hollow shaft 103, which carries the bell-shaped plate 102, with the turbine wheel 104. The bearing unit 101 is located in the atomizer housing 105. Drive air A is supplied to the turbine wheel 104 from an external rpm regulator 117 over a hose 107 leading into the atomizer and a supply channel 108 used as the primary internal power supply line. From another output of the rpm regulator 117 the turbine wheel 104 receives braking air B via a valve VB and a separate line LB. The primary power supply channel 108 can also consist of several parallel channels opening at various points of the turbine wheel. In accordance with its description thus far, the atomizer can be a conventional electrostatic rotary atomizer. Also the operation of the rpm regulator, which compares an actual value, e.g., detected optoelectronically, with a desired value, and, if there are deviations, drives loading and release valves of an actuator and can also drive a brake valve, is known.

According to the illustration, the air power supply segment of the turbine formed by the hose 107 and the channel 108 includes a valve arrangement 110 driven pneumatically or electrically. At this point, a separate channel 111, which can be blocked, for switching air branches off and also opens at this point for driving the turbine wheel 104. Several additional channels 111 with several nozzles on the turbine wheel can also be provided.

The exhaust gas of the turbine is led through the atomizer flange on the path indicated at 113 from the atomizer and, e.g., into the arm of the painting robot.

During operation, for low drive energy requirements, the branch of the valve arrangement 110 leading into the separate channel 111 is closed, so that the turbine is driven in the previously conventional way only over the channel 108.

Due to increased paint output or for the use of a larger bell-shaped plate 102, etc., if the drive energy demands are increased over a threshold that pertains to the normal air supply through the channel 108, then the branch of the valve arrangement 110 leading into the channel 111 is opened so that the turbine is supplied with a greater amount of air through the added channel 111, and thus with the necessary additional energy. The air hose 107 led from outside into the atomizer has a cross section that is dimensioned so that all of the necessary air can be made available. In contrast, a relatively small diameter is sufficient for the channel 108. For lower energy requirements or when the nominal rpm is achieved at a high speed for an atomizer with increased air output, the path into the channel is closed again, so that the air consumption of the amount required for the torque that is now necessary decreases.

Instead of a simple open/closed function, the valve arrangement 110 can also throttle the path into the channel 111 (or the paths into the two channels 108 and 11) to values favorable for the corresponding operating and control conditions. If necessary, this throttling can be set and changed automatically.

One of the possibilities mentioned in the introduction for heating components, which are cooled too strongly, by using the exhaust air of the atomizer according to FIG. 1, is to heat the steering air, e.g., with an electric heating device, e.g., which is arranged outside of the atomizer and which passes through the line 18, through the valve housing 15, and through the bearing unit 19 of the compressed air turbine 5. A corresponding situation applies for the steering air flowing through the holes 13 and 14. Similar channels could also be provided for a gaseous or liquid heating medium, which is not used as steering air, but instead is led out of the atomizer along other paths.

In contrast, if the drive air of the turbine is warmed, it is preferably led through a heat exchanger 116 after heating by the electric heating device 115, e.g., illustrated schematically in FIG. 2. The path 113 of the exhaust gas also leads through the heat exchanger so that the exhaust gas is also heated by the supply air in the way known for such devices. If it is not installed in the atomizer, the heat exchanger 116 should be arranged as close as possible to the atomizer.

As likewise shown in FIG. 2, the temperature of the drive air A is controlled by a temperature regulator 118, which compares the actual value signal $t_i$ coming from at least one temperature sensor (not illustrated) located in the atomizer with a desired value signal $t_s$ and controls the heating device 115 depending on the result. As already mentioned, the control signal st of the heating device could also be set without a control loop through the use of program data stored as desired values.

The invention has been described in an illustrative manner, and it is to be understood that the terminology which has been used is intended to be in the nature of words of description rather than limitation.

Obviously, many modifications and variations of the present invention are possible in light of the above teachings it is, therefore, to be understood that within the scope of the appended claims, wherein reference numerals are merely for convenience and not to be in any way limiting, the invention may be practiced otherwise than as specifically described.

What is claimed is:

1. A coating device with a rotary atomizer mounted on a coating machine, with a turbine motor of the rotary atomizer driven by a fluid stream, with a shaft of the rotating atomizer driven by the turbine motor and being supported by a bearing unit, with an inlet path through which the fluid stream is supplied under pressure to a turbine wheel of the turbine motor, and with an outlet path through which the fluid stream at a lower-pressure evacuates from the bearing unit, the device comprising:

a heating device for heating one of the fluid stream flowing through the turbine wheel, the inlet path, and the outlet path including a heat exchanger positioned along both the inlet path and the outlet path.

2. The coating device according to claim 1 wherein the heating device is located outside of the rotary atomizer.

3. The coating device according to claim 1 wherein the bearing unit includes channels separate from the inlet and outlet paths with a medium heated by the heating device flowing through said channels.

4. The coating device according to claim 1 further comprising:

at least one temperature sensor.

5. A coating device comprising:

a turbine including an inlet for receiving a first fluid stream and an outlet for evacuating the first fluid stream and a rotatable shaft;

a bearing supporting the shaft of the turbine in rotation;

a rotary alomizer connected to the shaft and positioned externally with respect to the housing adjacent the second end and including a bell-shaped plate;

at least one steering passage for communicating a second fluid stream towards the bell-shaped plate; and a heater for heating-the first fluid stream positioned downstream of the outlet.

6. The coating device of claim 5 wherein the heater heats the first fluid stream and is positioned upstream of the inlet.

7. The coating device of claim 5 wherein the heater heats the first fluid stream upstream of the inlet and downstream of the outlet.

8. The coating device of claim 5 wherein the heater heats the bearing.

9. The coating device of claim 8 wherein the bearing is an air bearing and the heater heats an air stream passing through the bearing.

10. A coating device comprising:

a turbine including an inlet for receiving a first fluid stream and an outlet for evacuating the first fluid stream and a rotatable shaft;

a bearing supporting the shaft of the turbine in rotation;

a rotary atomizer connected to the shaft and positioned externally with respect to the housing adjacent the second end and including a bell-shaped plate;

at least one steering passage for communicating a second fluid stream toward the bell-shaped plate; and a heater for heating the first fluid stream upstream of the inlet and downstream of the outlet.

11. A rotary atomizer for applying a coating, comprising:

a turbine motor, a shaft driven by said turbine motor supported by a bearing unit, a rotating bell-shaped plate supported on said shaft receiving coating from said rotary atomizer, a fluid passage extending through said rotary atomizer receiving fluid under pressure and driving said turbine motor, said fluid passage having an outlet directing fluid toward said rotary bell-shaped plate, thereby shaping a coating sprayed by said rotating bell-shaped plate, and a heater heating fluid received through said fluid passage, thereby heating fluid driving said turbine motor and fluid directed toward said bell-shaped plate, thereby reducing water condensation of fluid received through said fluid passage.

12. A rotary atomizer for applying a coating, comprising:

a turbine motor, a shaft driven by said turbine motor supported by a bearing unit, a rotating bell-shaped plate supported on said shaft receiving coating from said rotary atomizer, a fluid passage extending through said rotary atomizer around said bearing unit and having an outlet directing fluid toward said rotating bell-shaped plate, thereby shaping a coating sprayed by said rotating bell-shaped plate, and a heater heating fluid received through said fluid passage, thereby heating fluid received round said bearing unit and fluid directed toward said rotating bell-shaped plate, thereby reducing water condensation of fluid received through said fluid passage.

13. A rotary atomizer for applying a coating, comprising:

a turbine motor supported by a bearing unit driven by a fluid stream, a shaft of said rotary atomizer driven by said turbine motor, an inlet path through which said fluid stream is supplied tinder pressure to a turbine wheel of said turbine motor, and an outlet path through which said fluid stream evacuates said bearing unit at a lower pressure; and a heating device for heating one of said fluid stream flowing through said turbine wheel, said inlet path and said outlet path, a temperature sensor connected to a temperature regulator regulating said heating device to maintain a temperature of one of said fluid stream, inlet path and outlet path to reduce water condensation and wherein said heating device heats said fluid stream upstream at said inlet path and downstream of said outlet path.

* * * * *

UNITED STATES PATENT AND TRADEMARK OFFICE

CERTIFICATE OF CORRECTION

PATENT NO. : 6,972,052 B2
DATED : December 6, 2005
INVENTOR(S) : Harry Krumma et al.

It is certified that error appears in the above-identified patent and that said Letters Patent is hereby corrected as shown below:

Column 6,
Line 56, delete "-" after "heating.".

Column 8,
Line 16, delete "tinder" and insert -- under --.

Signed and Sealed this

Twenty-first Day of February, 2006

JON W. DUDAS
*Director of the United States Patent and Trademark Office*